US007639965B2

(12) United States Patent
Palumbo et al.

(10) Patent No.: US 7,639,965 B2
(45) Date of Patent: Dec. 29, 2009

(54) ARCHITECTURE FOR AN IMAGE-FORMING DEVICE

(75) Inventors: Franklin Joseph Palumbo, Nicholasville, KY (US); Darin M. Gettelfinger, Lexington, KY (US); Paul Douglas Horrall, Lexington, KY (US); Reginald Keith Bethel, Lexington, KY (US); David Anthony Schneider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 463 days.

(21) Appl. No.: 11/407,307

(22) Filed: Apr. 19, 2006

(65) Prior Publication Data

US 2007/0248377 A1 Oct. 25, 2007

(51) Int. Cl.
*G03G 15/00* (2006.01)

(52) U.S. Cl. ..... 399/107; 399/124; 399/392

(58) Field of Classification Search ..... 399/107, 399/124, 392
See application file for complete search history.

(56) References Cited

U.S. PATENT DOCUMENTS

| | | | |
|---|---|---|---|
| 4,009,958 | A | 3/1977 | Kurita et al. |
| 4,386,838 | A | 6/1983 | Hirabayashi et al. |
| 4,432,632 | A | 2/1984 | Yokota |
| 4,585,329 | A | 4/1986 | Landa |
| 4,615,605 | A | 10/1986 | Kida et al. |
| 4,639,119 | A | 1/1987 | Isaka |
| 4,657,372 | A | 4/1987 | Ikeda et al. |
| 4,678,318 | A | 7/1987 | Bisaiji |
| 4,692,018 | A | 9/1987 | Tamura |
| 4,757,344 | A | 7/1988 | Idenawa et al. |
| 4,761,667 | A | 8/1988 | Miyai et al. |
| 4,791,454 | A | 12/1988 | Takahashi et al. |
| 4,862,212 | A | 8/1989 | Tanzawa et al. |
| 4,866,482 | A | 9/1989 | Hirasawa et al. |
| 4,873,548 | A | 10/1989 | Kobayashi et al. |
| 4,901,110 | A | 2/1990 | Tompkins et al. |
| 4,924,267 | A | 5/1990 | Yoshikawa et al. |
| 4,926,219 | A | 5/1990 | Hirasawa et al. |
| 4,943,828 | A | 7/1990 | Manabe et al. |
| 4,987,446 | A | 1/1991 | Mochimaru et al. |
| 5,027,158 | A | 6/1991 | Tompkins et al. |
| 5,061,959 | A | 10/1991 | Kinoshita et al. |
| 5,153,640 | A | 10/1992 | Okabe |
| 5,160,963 | A | 11/1992 | Haneda et al. |
| 5,160,964 | A | 11/1992 | Takahashi et al. |
| 5,170,209 | A | 12/1992 | Tompkins et al. |
| 5,189,471 | A | 2/1993 | Irihara et al. |
| 5,266,998 | A | 11/1993 | Lee |

(Continued)

*Primary Examiner*—David M Gray
*Assistant Examiner*—Ryan D Walsh
(74) *Attorney, Agent, or Firm*—Coats and Bennett PLLC

(57) ABSTRACT

An image forming device includes a body having a top, a bottom, a front and a back. In one embodiment, a plurality of horizontally-aligned imaging units, each comprising a photoconductive member, transfer toner images to an intermediate transfer mechanism located below the plurality of imaging units. A pick mechanism may pick media sheets from a media input tray and feeds the media towards the front of the body. For duplex printing, the media sheets may travel along a duplex path that extends along the front of the body. In one embodiment, an access door at the front of the body pivots between a closed position and an open position. In the open position, a user may gain access to both media paths.

21 Claims, 3 Drawing Sheets

U.S. PATENT DOCUMENTS

| | | | | |
|---|---|---|---|---|
| 5,276,479 | A | 1/1994 | Inomata | |
| 5,294,960 | A | 3/1994 | Nomura et al. | |
| 5,309,211 | A | 5/1994 | Yoshioka | |
| 5,323,210 | A | 6/1994 | Inomata | |
| 5,367,363 | A | 11/1994 | Kai et al. | |
| 5,371,575 | A | 12/1994 | Sekino et al. | |
| 5,402,212 | A | 3/1995 | Ito et al. | |
| 5,440,373 | A | 8/1995 | Deki et al. | |
| 5,442,421 | A | 8/1995 | Kojima | |
| 5,452,064 | A | 9/1995 | Inomata | |
| 5,528,343 | A | 6/1996 | Tada et al. | |
| 5,537,187 | A | 7/1996 | Sekine | |
| 5,585,889 | A | 12/1996 | Shishido et al. | |
| 5,604,570 | A | 2/1997 | Jeran et al. | |
| 5,646,720 | A | 7/1997 | Song | |
| 5,666,599 | A | 9/1997 | Miyasaka et al. | |
| 5,682,579 | A | 10/1997 | Nomura et al. | |
| 5,699,091 | A | 12/1997 | Bullock et al. | |
| 5,742,319 | A | 4/1998 | Fukunaga et al. | |
| 5,787,324 | A | 7/1998 | Iwasaki | |
| 5,802,432 | A | 9/1998 | Coffey et al. | |
| 5,815,664 | A | 9/1998 | Asano | |
| 5,815,775 | A | 9/1998 | Miyasaka et al. | |
| 5,907,749 | A | 5/1999 | Nomura et al. | |
| 5,920,752 | A | 7/1999 | Karakama et al. | |
| 5,953,559 | A | 9/1999 | Obu | |
| 5,966,566 | A | 10/1999 | Odagawa et al. | |
| 6,085,051 | A | 7/2000 | Miyasaka et al. | |
| 6,118,961 | A | 9/2000 | Nomura et al. | |
| 6,163,666 | A | 12/2000 | Hosokawa et al. | |
| 6,347,204 | B1 | 2/2002 | Kurosawa | |
| 6,377,765 | B1 | 4/2002 | Shishido et al. | |
| 6,381,428 | B1 | 4/2002 | Yamamoto et al. | |
| 6,384,940 | B1 | 5/2002 | Kawai et al. | |
| 6,445,895 | B2 | 9/2002 | Shirasawa et al. | |
| 6,484,003 | B2 | 11/2002 | Tokutake et al. | |
| 6,501,925 | B2 | 12/2002 | Yamamoto et al. | |
| 6,697,586 | B2 | 2/2004 | Yamamoto et al. | |
| 6,798,430 | B2 | 9/2004 | Sato | |
| 2001/0028810 | A1 | 10/2001 | Yamaguchi et al. | |
| 2003/0235430 | A1* | 12/2003 | Koshida | 399/124 |
| 2004/0131384 | A1* | 7/2004 | Miyaji et al. | 399/124 |
| 2005/0163533 | A1* | 7/2005 | Hashimoto et al. | 399/124 |

* cited by examiner

ARCHITECTURE FOR AN IMAGE-FORMING DEVICE

BACKGROUND

The present application is directed to image forming devices and, more specifically, to architectures of image forming devices.

Image forming devices, such as color laser printers, produce images on print media that pass along a media path. One drawback to these conventional devices is their relatively large size. Particularly, these devices typically include additional components necessary for aligning media along the media path, duplex printing, and cooling, for example. While these components may provide high-quality images, they necessarily increase the overall size of the device. The overall size is an important aspect for consumers when purchasing a device. Workspace, such as a desktop, is often limited and is not able to accommodate large devices. Further, large devices are more difficult to physically lift and move around a workspace. Smaller devices are more convenient for moving and positioning in new locations.

Another important aspect is their ease of use. Media input and output areas, for example, should be easily accessible to a user. The locations of these areas should allow a user to load and unload the print media without moving the device. The user should also be able to remove media that becomes jammed in the media path without having to move the device from its position.

Consumers also consider the overall cost of the device. The architecture of the device should not greatly affect the cost of the device. An architecture that increases the overall cost may be a detriment to a consumer.

SUMMARY

The present application is directed to image-forming devices with architectures that reduce the size of the device. In one embodiment, the device comprises a body having a front, a rear, a top, and a bottom. A media input tray may be disposed at the bottom of the device, and may be inserted into and removed from the image-forming device through the front of the body. A plurality of imaging units, each comprising a photoconductive member, may be horizontally-aligned between the front and the rear of the body. The imaging units transfer toner images to an intermediate transfer mechanism located below the plurality of imaging units and above the media tray. A pick mechanism may pick media sheets from the media input tray and feed the media sheets towards the front of the body. The media sheets may travel along a first media path and receive the toner image at a secondary transfer area located at the front of the body. An access door disposed on the front of the device opens to allow access to the interior of the body.

DETAILED DESCRIPTION

The present application is directed to an architecture for an image-forming device that provides color and/or monochrome printing capabilities. The device architecture minimizes the overall size of the device, and provides straightforward access to the input and output ports and the media path. The architecture may also reduce the cost and the complexity of the device.

In one embodiment, the image forming device comprises a color laser printer. The printer may be sized to fit on a workspace, such as a desktop. A user may use the printer to produce monochrome and/or color images. The printer further includes accessible work areas to allow the user to insert and remove media sheets, and clear media jams from the interior of the printer.

Figure 1:
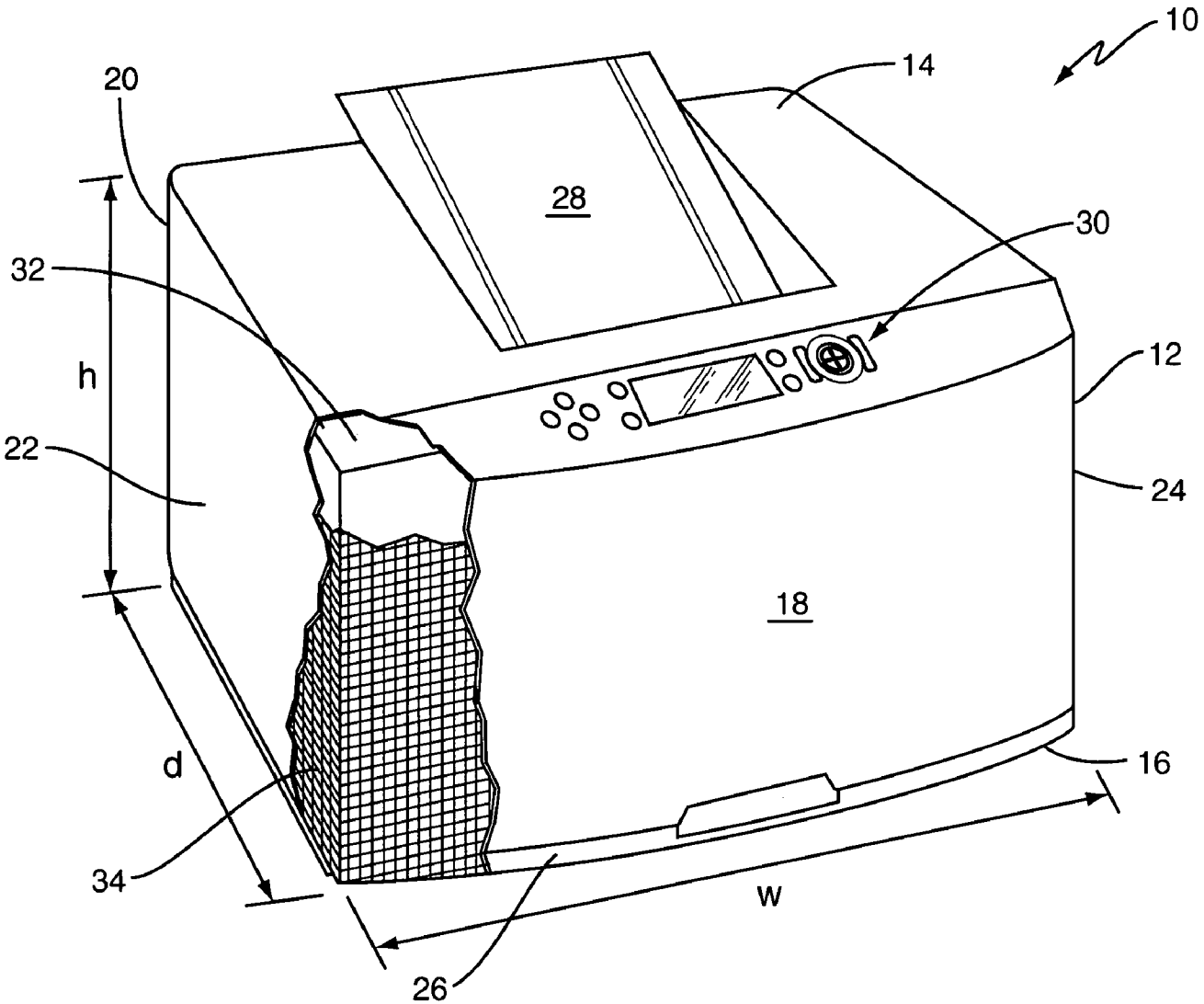
FIG. 1 is a perspective view illustrating an image-forming device according to one embodiment.

FIG. 1 illustrates one embodiment of a representative image-forming device, such as a color laser printer, indicated generally by the numeral 10. The device 10 includes a body 12 having a top 14, a bottom 16, front 18, a back 20, a first side 22, and a second opposing side 24. The device 10 may include a media input tray 26 sized to contain media, and a media output area 28. A control panel 30 is accessible from the exterior to control the operation of the device 10. For reference, the height h of the device 10 is the distance between the bottom 16 and the top 14 of the device 10. A depth d of the device 10 is the distance between the front 18 and the back 20 of the device 10. A width w of the device 10 is the distance between the first side 22, and the second side 24 of the device 10. The dimensions h, d, and w may be any length desired. However, in one embodiment, the overall height h of the device 10 is less than the overall depth d of device 10.

The media input tray 26 is disposed in the bottom 16 of the body 12, and contains a stack of media sheets on which the device 10 will form color and/or monochrome images. The media input tray 26 is preferably removable for refilling. Therefore, in this embodiment, a user may insert and remove the media input tray 26 from the device 10 through the front 18 of the body 12. Locating the media input tray 26 in the front bottom portion of the body 12 allows the user to insert and remove the media input tray 26 without re-positioning or moving the image-forming device 10.

The control panel 30 is also located on the front 18 of the body 12. Using the control panel 30, the user is able to enter commands and generally control the operation of the image-forming device 10. For example, the user may enter commands to switch modes (e.g., color mode, monochrome mode), view the number of images printed, take the device 10 on/off line to perform periodic maintenance, and the like.

The image-forming device 10 may also include one or more power supplies to provide power to the component parts of device 10. As seen in this embodiment, a low voltage power supply (LVPS) 32 is disposed in a vertical orientation at the front 18 of the body 12. This vertical orientation may provide a chimney effect for removing heat from the interior of the body 12. A first rigid support frame member 34 at least partially surrounds the LVPS 32; however, the depiction in FIG. 1 is for illustrative purposes only. The first rigid support frame member 34 may substantially surround the LVPS 32 in some embodiments.

Vertically orientating the LVPS 32 at the front 18 of the body 12 may reduce the overall size of device 10. Particularly, the LVPS 32 is positioned such that it is located proximate a fusing area 70 (shown in FIG. 2). Because of the proximity of these two components, this embodiment requires fewer cooling devices (e.g., fans) to cool the device 10. Additionally, the first rigid support frame member 34 also provides a dual function. Specifically, the first rigid support frame member 34 is part of a support frame (shown in FIG. 2) that supports the body 12 of device 10. Because the first rigid support frame member 34 at least partially surrounds the LVPS 32, the support member 34 also electrically shields the LVPS 32 from the interior of the device 10.

Figure 2:
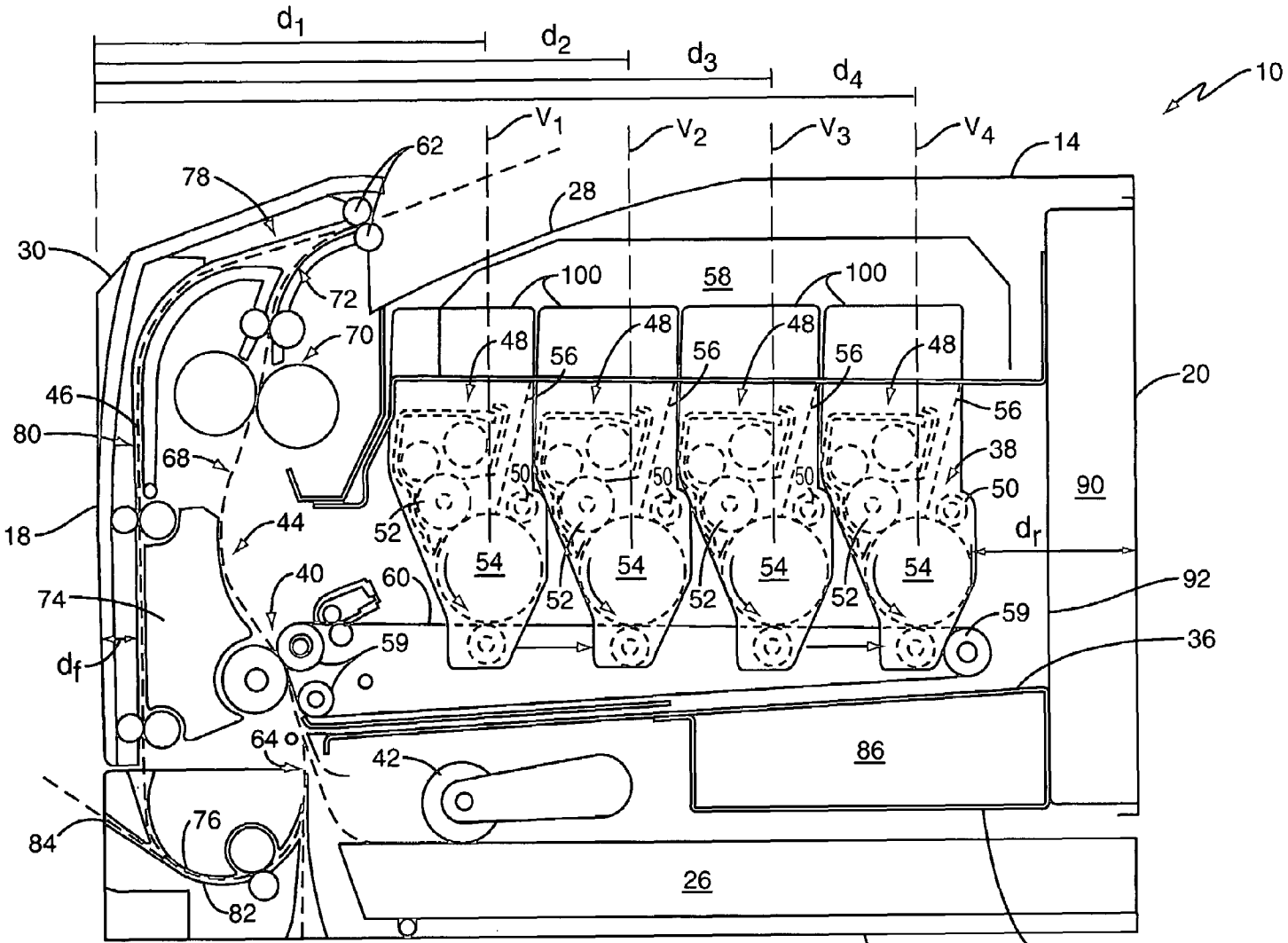
FIG. 2 is a side schematic view illustrating an image-forming device according to one embodiment.

FIG. 2 illustrates some of the component parts disposed in the interior of device 10. As seen in FIG. 2, the device 10 comprises, inter alia, a support frame 36 to support the body 12, a first toner transfer area 38, a second transfer toner area 40, a pick mechanism 42, a first media path 44, and a duplex path 46.

The first toner transfer area 38 includes one or more imaging units 48 that are aligned horizontally extending from the front 18 to the back 20 of the body 12. Each imaging unit 48 includes a charging roll 50, a developer roll 52, and a rotating photoconductive (PC) drum 54. The charging roll 50 forms a nip with the PC drum 54, and charges the surface of the PC drum 54 to a specified voltage such as −1000 volts, for example. A laser beam 56 from print head 58 contacts the surface of the PC drum 54 and discharges those areas it contacts to form a latent image. In one embodiment, areas on the PC Drum 54 illuminated by the laser beam 56 are discharged to approximately −300 volts. The developer roll 52, which also forms a nip with the PC drum 54, then transfers negatively charged toner particles from a toner reservoir 100 to the PC drum 54 to form a toner image. The toner particles are attracted to the areas of the PC drum 54 surface discharged by the laser beam 56.

In one embodiment, a toner reservoir 100 is operatively connected to each of the imaging units 48. The toner reservoirs 100 are sized to contain toner that is transferred to the imaging units 48 for image formation. The toner reservoirs 100 may be mounted and removed from the device 10 independently from the imaging units 48. In one embodiment, the toner reservoirs 100 each contain one of black, magenta, cyan, or yellow toner. In one embodiment, each of the toner reservoirs 100 is substantially the same. In another embodiment, the toner reservoirs 100 include different capacities. In one specific embodiment, the toner reservoir that contains black toner has a higher capacity.

Figure 3:
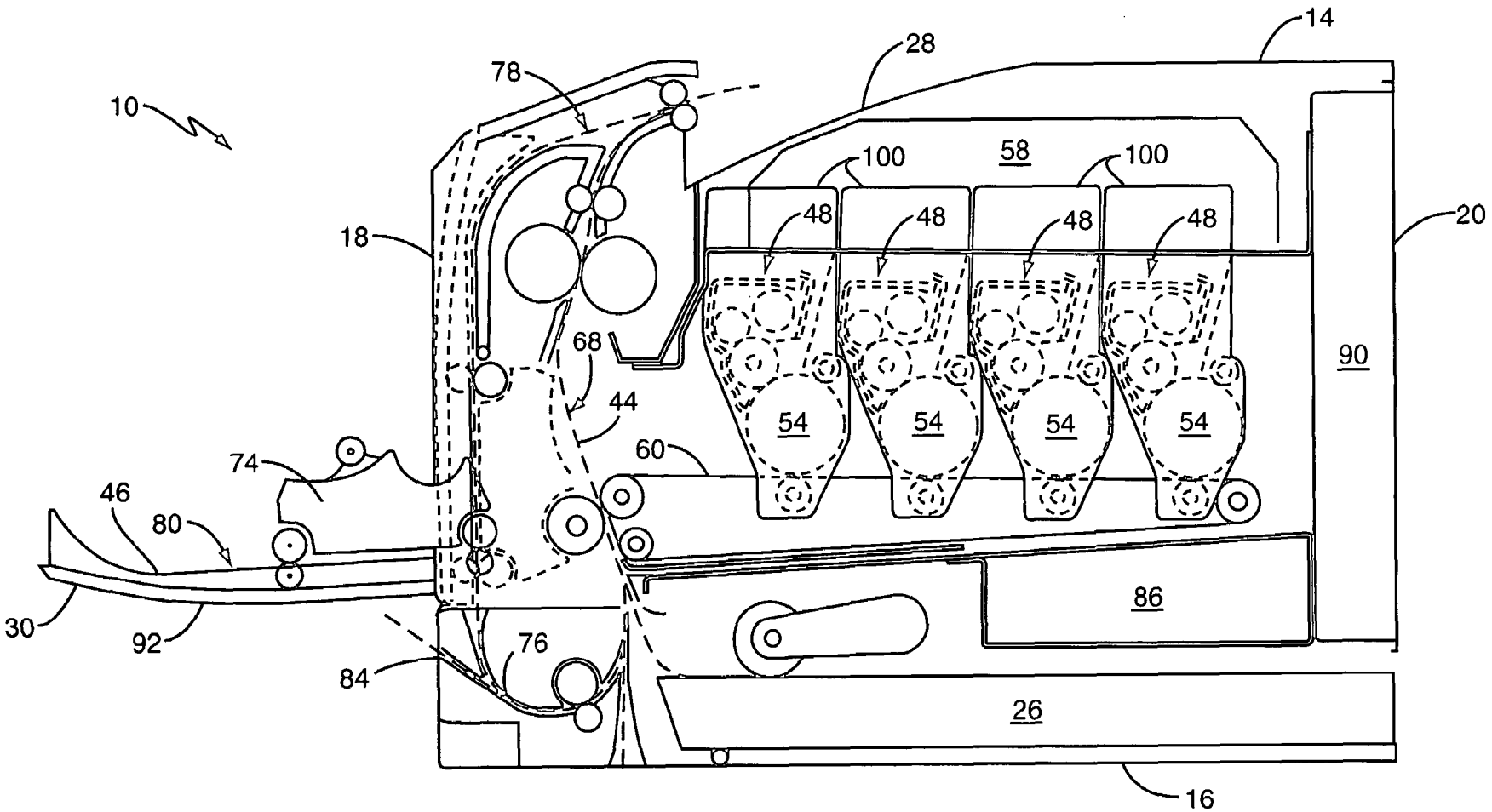
FIG. 3 is a side schematic view illustrating an access door in an open orientation according to one embodiment.

In one embodiment as illustrated in FIGS. 2 and 3, the toner reservoirs 100 mount from the top 14 of the device 10. The reservoirs 100 may detach during removal with the imaging units 48 remaining within the device 10. Removal and insertion from the top 14 allows changing the reservoirs 100 without requiring opening of side doors. This allows the device 10 to be placed in confined areas as the user will understand that access is only necessary from the top 14. The imaging units 48 may be removed from a side of the device 10. The toner reservoirs 100 are positioned within the device 10 to the side of the imaging units 48. This positioning reduces the overall height of the device 10, and is different from some previous devices that stored toner between the print head 58 and the PC drums 54.

As seen in FIG. 2, each PC drum 54 rotates about an axis, and lies on a distinct vertical plane $v_1$-$v_4$ that extends perpendicularly to the axes of rotation. The planes $v_1$-$v_4$ are spaced at different distances from the front 18 of the body 12. Thus, each imaging unit 48 is likewise spaced at a different distance $d_1$-$d_4$ from the front 18 of the body 12. Aligning the imaging units horizontally reduces the overall height h of the device 10.

The first transfer area 38 also includes an intermediate transfer mechanism (ITM) 60 disposed horizontally below the imaging units 48. In this embodiment, the ITM 60 is formed as an endless belt trained about a plurality of support rollers 59. However, in other embodiments, ITM 60 may be formed as a rotating drum. During image forming operations, the ITM 60 moves in the direction of the arrows past the imaging units 48. One or more of the PC drums 54 apply toner images in their respective colors to the ITM 60. In one embodiment, a positive voltage field attracts the toner image from the PC drums 54 to the surface of the moving ITM 60. The ITM 60 then conveys the toner images to the secondary transfer area 40, which transfers the toner image to a media sheet, such as a sheet of paper, for example.

The media input tray 26 is sized to contain a stack of media sheets. The pick mechanism 42 is positioned adjacent to the input tray 26 for moving an uppermost media sheet from the media input tray 26 toward the front 18 of the body 12 and into the first media path 44. In this embodiment, the pick mechanism 42 includes a roller that moves the media sheets from media input tray 26 towards the second transfer area 40 located towards the front 18 of the body 12. In one embodiment, the pick mechanism 42 is positioned in proximity (i.e., less than a length of a media sheet) to the secondary transfer area 40 with the pick mechanism 42 moving the media sheets directly from the input tray 26 into the secondary transfer area 40.

The first media path 44 extends between the media input tray 26 and discharge rollers 62. In this embodiment, the first media path 44 is substantially C-shaped. Particularly, the first media path 44 comprises a first curved section 64 that extends between the pick mechanism 42 and the second transfer area 40, a substantially vertical section 68 that extends between the second transfer area 40 and a fusing area 70, and a second curved section 72 that extends between the fusing area 70 and the output media area 28. Section 68 extends along the front 18 of the body 12, and is disposed between a duplex media path 46 and a front-most imaging unit 48. Section 68 is preferably in front of the ITM 60, and closer to the front 18 of body 12 than any of the imaging units 48. A deflector 74 may be disposed at the front 18 of the body 12 to guide the media sheets towards the fusing area 70.

The duplex media path 46 is also substantially C-shaped, and extends along the front 18 of the body 12 between the output media tray 28 and the first curved section 64 of the initial media path 44. Duplex media path 46 includes a series of rollers for moving the media sheet to a point upstream from the second transfer area 40 to receive a toner image on a second side of the media sheet. In this embodiment, the duplex path 46 includes a lower curved section 76, an upper curved section 78, and a substantially vertical section 80 that connects the upper and lower curved sections 76, 78. The substantially vertical section 80 extends along the front 18 of the body 12, and is positioned within the device 10 to be substantially perpendicular to the media input tray 26. As seen in FIG. 2, a distance $d_f$ between section 80 and the front 18 of the body 12 is less than the distance $d_r$ between a rear-most imaging unit 48*b* and the back 20 of the body 12.

The lower curved section 76 of the duplex media path 46 extends through an interior of the media input tray 26. In this embodiment, the lower curved section 76 shares a common media path with another feed path 82. The feed path 82 allows the user to feed media sheets manually into the device 10. In one embodiment, feed path 82 includes an inlet 84 for inserting the media sheets, and one or more rollers that move the sheets to the second transfer area 40.

Discharge rollers 62 are located downstream from the fuser area 70 and may be rotated in either forward or reverse directions. In a forward direction, the discharge rollers 62 move the media sheet from the initial media path 44 to the media output area 28. In a reverse direction, the discharge rollers 62 move the media sheet into the duplex path 46 for duplex printing.

A high-voltage power supply (HVPS) 86 may also disposed within the device 10. In this embodiment, HVPS 86 is located at the back 20 of the body 12 below a portion of the ITM 60 and above the media input tray 26. The HVPS 86 receives power from LVPS 32 and powers components, such as the ITM 60, PC drums 54, developer rolls 52, and charging rolls 50. A second rigid frame member 88 extends at least partially around the HVPS 86. As above, the second rigid frame member 88 is part of the support frame 36, and therefore, functions in part to support the body 12. However, the second rigid frame member 88 also electrically shields the HVPS 86 from the interior of the device 10.

The device 10 also includes a controller 90 to control the operation of the device 10, including image formation and motor engagement/disengagement. In one embodiment, controller 90 comprises one or more printed circuit boards (PCBs) having one or more microprocessors, random access memory, read only memory, and an input/output interface. In this embodiment, controller 90 is disposed at the back 20 of the body 12. A third rigid support member 92, which may be part of the support frame 36, substantially surrounds controller 90 to electrically shield the controller 90 from the interior of the device 10.

FIG. 3 illustrates a side view of the image forming device 10 showing how the user might gain access into the interior of the device 10 according to one embodiment. Particularly, an access door 92 may be positioned on the front 18 of the body 12. The access door 92 may pivot on a pivot member between an open position and a closed position. In the open position, access door 92 provides access to both the first media path 44 and the duplex media path 46 to allow the user to remove potentially jammed sheets. As seen in FIG. 3, the duplex media path 46 extends along an inside portion of the access door 92 such that the vertical section 80 and the deflector 74 moves with the access door 92.

In a closed orientation, the access door 92 forms a first side of the initial media path 44. Particularly, closing the access door 92 moves the deflector 74 into its position within the image-forming device 10. It also positions vertical section 80 of the duplex media path 46 such that it connects the lower and upper curved sections 76, 78 of the duplex media path 46.

In one embodiment, the control panel 30 is positioned on the access door 92. When the door is in the closed orientation as illustrated in FIG. 2, the control panel 30 faces in an upward direction and is accessible to a user. In the open orientation as illustrated in FIG. 3, the control panel 30 is inaccessible to the user. In one embodiment, the device 10 is not functional to create images while the access door 82 is in the open orientation and therefore access to the control panel 30 may be irrelevant.

In the embodiment illustrated, the image-forming device 10 is a color laser printer. Examples of such a printer include, but are not limited to, Model Nos. C750 and C752, each available from Lexmark International, Inc. of Lexington, Ky., USA. In another embodiment, image-forming device 10 is a mono printer comprising a single imaging unit 48 for forming toner images in a single color. In another embodiment, the image-forming device 10 is a direct transfer device that transfers the toner images from the one or more imaging units 48 directly to the media sheet.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An image-forming device comprising:

a body having a front and a back;

a control panel positioned on the front of the body;

a media input tray configured to be inserted into and removed from the body through an opening located in the front of the body;

a plurality of imaging units horizontally aligned within the body between the front and the back and each comprising a photoconductive member;

an intermediate transfer mechanism positioned within the body to receive toner images from the plurality of imaging units and move the toner images to a second transfer area;

a first media path having a substantially vertical section that extends between the front of the body and the intermediate transfer mechanism, and is positioned closer to the front of the body than each of the plurality of imaging units; and a second media path that extends substantially between the first media path and the front of the body, the second media path including an arcuate section extending below the vertical section and located substantially entirely within an interior of a front section of the media input tray.

2. The device of claim 1 wherein the vertical section extends substantially perpendicular to the media input tray.

3. The device of claim 1 wherein the front of the body includes an access door configured to pivot between an open position and a closed position, and wherein the access door exposes the first and second media paths when the access door is in the open position.

4. The device of claim 3 wherein the control panel is positioned on the access door, the control panel facing in a first direction when the access door is in the open position and facing in a second direction approximately 90 degrees different when the access door is in the closed orientation.

5. The device of claim 1 wherein each of the plurality of horizontally-aligned imaging units lie on a distinct vertical plane, each vertical plane being spaced from the front of the body by a different distance.

6. The device of claim 1 further comprising a plurality of toner reservoirs each removably connected to one of the plurality of imaging units, each of the plurality of toner reservoirs are mounted and removed through a top of the body.

7. The device of claim 1, wherein the media input tray includes an inlet for receiving a manually fed media sheet into the arcuate section of the second media path.

8. The device of claim 1, further comprising a fuser unit and a power supply disposed in an upper portion of the device proximal to the fuser unit.

9. The device of claim 1, wherein the arcuate section is substantially U-shaped.

10. An image-forming device comprising:

a media input tray configured to contain a stack of media sheets;

a body having a front and a back, the front of the body comprising an opening configured to receive the media input tray;

a control panel positioned on the front of the body;

an intermediate transfer mechanism located between the media input tray and a plurality of horizontally-aligned imaging units to receive toner from the imaging units and move the toner to a secondary transfer area;

a first media path comprising a substantially vertical section that extends between the front of the body and the intermediate transfer mechanism, the secondary transfer area being disposed along the first media path;

a pick mechanism configured to feed the media sheets from the media input tray towards the front of the body and into the vertical section of the first media path; and a second media path that extends between the front of the body and the vertical section of the first media path, the second media path to move media sheets to form an image on a second side, the second media path including an inlet for receiving a manually inserted media sheet into the second media path.

11. The device of claim 10 wherein a first distance between the front of the body and the second media path is less than or equal to a second distance between a rear-most imaging unit and the rear of the body.

12. The device of claim 10 wherein the front of the body includes an access door configured to pivot between an open position and a closed position, and wherein the access door exposes the first and second media paths when the access door is in the open position.

13. The device of claim 12 wherein the control panel is positioned on the access door.

14. The device of claim 10 further comprising a fusing mechanism disposed along the first media path to fuse toner to the media sheets, the distance between the secondary transfer area and the fusing mechanism being less than a length of the media sheets.

15. The device of claim 10, wherein the second media path includes an arcuate section located substantially entirely within the media input tray, the media input tray being at least partly removable from the body.

16. The device of claim 15, wherein the arcuate section is substantially U-shaped.

17. The device of claim 10, further comprising a fuser unit and a power supply disposed in an upper portion of the body proximal to the fuser unit.

18. An image-forming device comprising:

a media input tray configured to contain a stack of media sheets;

a body having a front and a back, the front of the body comprising an opening configured to receive the media input tray;

a control panel positioned on the front of the body;

an intermediate transfer mechanism located between the media input tray and a plurality of horizontally-aligned imaging units to receive toner from the imaging units and move the toner to a secondary transfer area;

a first media path comprising a substantially vertical section that extends between the front of the body and the intermediate transfer mechanism, the secondary transfer area being disposed along the first media path;

a pick mechanism configured to feed the media sheets from the media input tray towards the front of the body and into the vertical section of the first media path;

an access door configured to pivot between open and closed positions along the front of the body, for allowing for manual access to the first media path, wherein the control panel is positioned on the access door.

19. The device of claim 18, further comprising:

a second media path that extends between the front of the body and the vertical section of the first media path, the second media path to move media sheets to form an image on a second side, the second media path including a substantially U-shaped arcuate section extending below the vertical section and located substantially entirely within an interior of a front section of the media input tray.

20. The device of claim 19, further comprising an inlet disposed within the media input tray, for receiving a manually fed media sheet into the second media path.

21. The device of claim 18, further comprising an inlet disposed within the media input tray, for receiving a manually fed media sheet.

* * * * *

UNITED STATES PATENT AND TRADEMARK OFFICE

CERTIFICATE OF CORRECTION

PATENT NO. : 7,639,965 B2
APPLICATION NO. : 11/407307
DATED : December 29, 2009
INVENTOR(S) : Palumbo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 717 days.

Signed and Sealed this

Twenty-first Day of December, 2010

David J. Kappos

David J. Kappos
*Director of the United States Patent and Trademark Office*